United States Patent [19]

McCorkle

[11] Patent Number: 4,667,954

[45] Date of Patent: May 26, 1987

[54] PUNCHING BAG

[76] Inventor: George O. McCorkle, 4015 The Alameda, Baltimore, Md. 21218

[21] Appl. No.: 781,654

[22] Filed: Sep. 30, 1985

[51] Int. Cl.[4] ..... A63B 69/00

[52] U.S. Cl. ..... 272/76; 272/77; 273/55 R; 273/55 A

[58] Field of Search ..... 272/76, 77, 143; 273/55 R, 55 A; 2/44, 45, 267; D21/199

[56] References Cited

U.S. PATENT DOCUMENTS

| | | | |
|---|---|---|---|
| D. 168,302 | 12/1952 | Holt | D21/199 |
| 2,526,217 | 10/1950 | Gilman | 272/76 |
| 3,396,969 | 8/1968 | Rosenfeld | 273/55 R |

OTHER PUBLICATIONS

Premier Products Catalog, "Iowa Blocker" p. 3, 1964.
Gilman Gear Catalog, "Pushback" p. 19, 1958.

*Primary Examiner*—Richard J. Apley
*Assistant Examiner*—J. Welsh
*Attorney, Agent, or Firm*—A. W. Breiner

[57] ABSTRACT

A portable punching bag for use in training boxers, comprising a durable covering material having back, front, and side walls of a rectangular shape, a resilient impact absorbing filler material which is inserted through one of the walls and held in place by flaps in the wall, the back wall having a first set of forearm and hand grips for the holders right hand and forearm and a second set of forearm and hand grips for the holders left and forearm.

9 Claims, 3 Drawing Figures

PUNCHING BAG

FIELD OF INVENTION AND BACKGROUND

This invention relates to punching bags, and more particularly to a portable hand and forearm held punching bag. The punching bag may also have shoulder straps to provide additional support.

Punching bags have primarily been limited to the stationary punching bags such as illustrated in U.K. Patent Application No. 2,063,083, or a heavy body bag held from the ceiling, or an inflated punching bag held from a frame at head level. Further, hand held training dummies are known for simulated shoulder blocking in football, such as illustrated in U.S. Pat. Nos. 2,526,217 and 3,396,969. Further, hand-held striking pads are known for training in the martial arts. However, none of the known prior art teaches a hand and forearm-held punching bag capable of providing the hereinafter mentioned objects.

OBJECTS OF THE INVENTION

It is a primary object of this invention to provide a portable punching bag useful in increasing the speed and power of the boxer's hands.

It is a further primary object of this invention to provide a portable punching bag which will aid in training boxers to correct open glove punching and allow the boxer to box with the proper closed position.

It is a further object of this invention to provide a portable punching bag which will aid in training the boxer to improve his inside boxing. Specifically, the invention allows the boxer to develop his punching ability in the waist to shoulder target zone.

It is a further object of the invention to provide a portable punching bag which can be used any place in the gym or other training facility.

It is a further object of the invention to provide a punching bag which is supported by another person, such as a boxer or trainer, from approximately waist to shoulder level and close to the body which provides for a moving target, thereby simulating actual boxing situations.

It is a further object of this invention to provide a portable punching bag which provides both a stationary or moving target to teach straight punching techniques.

It is a further object of this invention to provide a portable punching bag which is held by both hands and forearms to provide for a firm grip to the person holding the punching bag. The punching bag may also have shoulder straps to provide additional support. Further, the novel hand and forearm holding means allows the person holding the punching bag to draw the bag close to his body from approximately the waist to shoulder level, effectively making the punching bag part of the holder's body, allowing movement of the punching bag by the holder. Further, the punching bag allows the person holding the punching bag to receive harder blows to the punching bag and to provide a greater resistance to the boxer.

Other objects and advantages of this invention will be apparent to those skilled in the art from the following detailed description, figures of the drawing, and the appended claims.

THE DRAWING AND DETAILED DESCRIPTION

Figure 1:
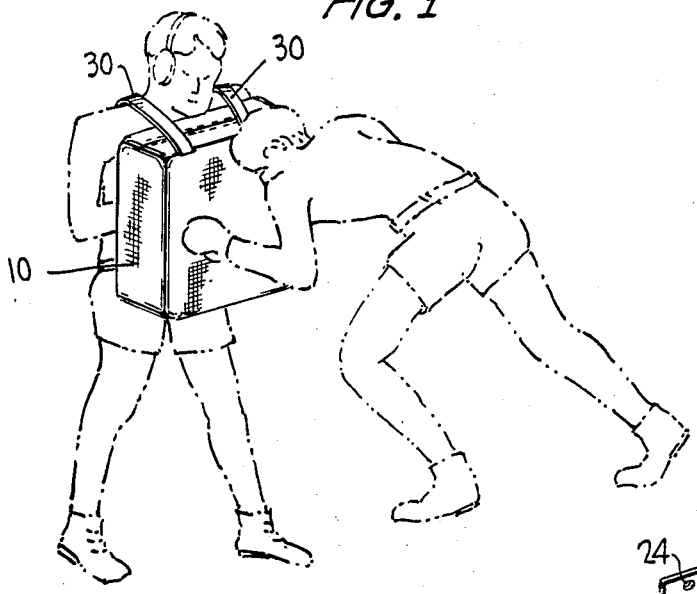
FIG. 1 is a perspective view of the punching bag shown as in actual use.

Referring to the drawings, FIG. 1 shows the portable punching bag as held by the person assisting the boxer, such as another boxer or trainer, and ready for actual use by the boxer.

Figure 2:
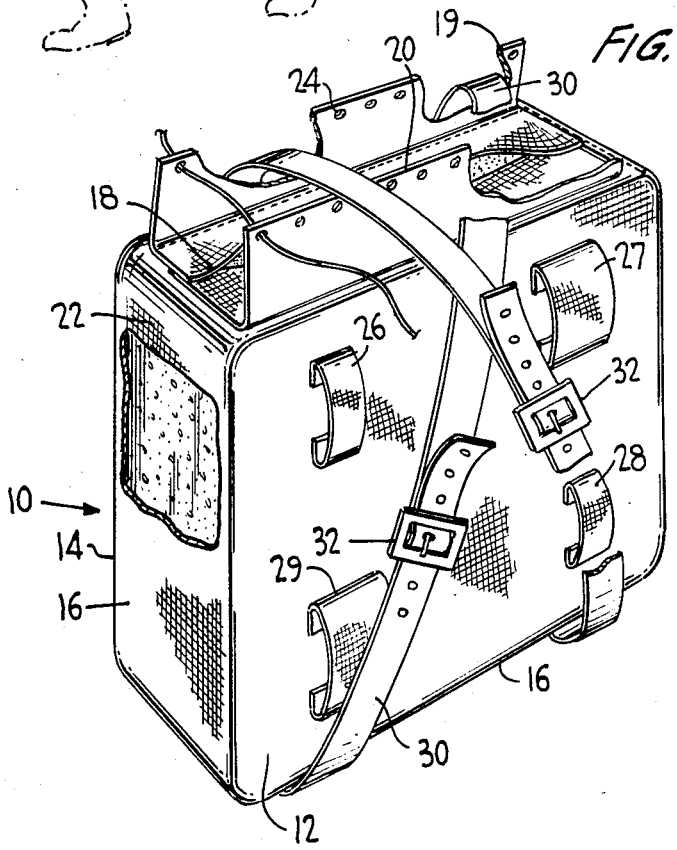
FIG. 2 is a perspective view showing the back, top, and side of the punching bag, including a partial cross-sectional view.

Referring to FIG. 2 of the drawings, there is shown a rectangular punching bag 10 comprised primarily of a covering material 12, 14, and 16, filler material 22, and means for retaining said filler material 19 and 20, and means for holding the punching bag 26, 27, 28 and 29. Straps 30 provide additional means for holding the punching bag in place. Punching bag 10 should be of a size and weight capable of being held by the holder at approximately waist to shoulder level.

Specifically, punching bag 10 is shown having a back wall or sheet 12, a front wall or sheet 14, and a continuous side, bottom, and top strip 16 with an opening 18 at the top of punching bag 10. Opening 18 is sufficiently large to allow for insertion of the filler material 22. The back wall 12, front wall 14, and side walls 16 are joined or fastened together by any conventional means such as stitching. The preferable means of joining walls 12, 14, and 16 is by an inside stitching leaving no rough edges on the outer surface of the punching bag.

Figure 3:
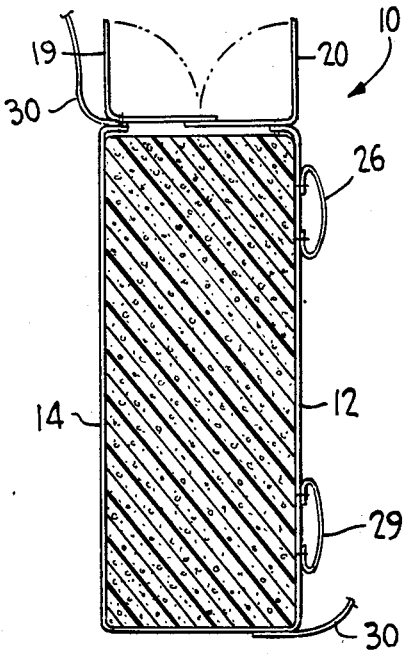
FIG. 3 is a side view of the punching bag showing one means of retaining the filler material of the invention.

The top of punching bag 10 contains an opening 18 for insertion of the filler material 22. Attached to front and back walls 12 and 14 are flaps 19 and 20. Flaps 19 and 20 are joined or fastened to walls 12 and 14 by any conventional means such as stitching. After the filling material 22 is inserted into punching bag 10, flaps 19 and 20 are placed in a closed position as shown by phantom lines in FIG. 3 and are fastened to hold the filler material firmly in place. A preferred embodiment of the invention includes eyelets 24 in flaps 19 and 20 through which a string-like material 26 may be placed as shown in FIG. 2 and tied to close flaps 19 and 20 and firmly retain the filler material.

It is envisioned that alternate means of inserting the filler material 22 in the punching bag and of retaining the filler material may be used. For example, the opening 18 may be in any of the side walls 16. Further, the opening may be closed by other means such as a zipper, snaps, or velcro. Further, in the alternative, the filler material may be enclosed in the punching bag by, inter alia, stitching during manufacture, and having no opening 18 or flaps 19 and 20.

The covering material for punching bag 10 may be any durable natural or synthetic material. A preferred covering material is canvas. Other durable covering materials such as vinyl may also be used.

The filler material 22 is preferably a resilient impact absorbing material. A preferred material is a polyurethane foam block. Other polymer foams may also be used as the filler material either as a foam block or foam pieces.

Referring to FIG. 2, it is seen that back wall 12 includes hand grips 26 and 28 and forearm grips 27 and 29. The hand and forearm grips are firmly joined or fastened to wall 12 by any conventional means such as stitching. The hand and forearm grips can be made of any durable material and preferably are made of the same material as walls 12, 14 and 16, and covering flaps 19 and 20. A preferred material is canvas.

Referring again to FIG. 2, it is seen that the punching bag 10 may also have shoulder straps 30 which provide additional means for holding the punching bag. The straps can be made of any durable material and are preferably made of the same material as walls 12, 14 and 16. The straps 30 should have conventional adjustment means 32 as in known in the art.

Punching bag 10 is held by placing straps 30 over the sholders and then placing the right hand and forearm through a forearm grip 27 and firmly grasping hand grip 26, and placing the left hand and forearm through forearm grip 29 and firmly grasping hand grip 28. Straps 30 are adjusted to place the punching bag close to the holder's body. The punching bag is now in the firm grasp of the holder and tucked into the holders body as shown in FIG. 1, and is now ready for use by the boxer.

Handle grips 26 and 28 should be sufficiently wide to allow for a firm grip by the holder. The handle grips may be made of the desired material alone or may contain a filler material such as a foam material to provide for a more comfortable grip.

While punching bag 10 is shown for placement of the right hand and forearm above the left hand and forearm, such placement may be reversed by reversing the placement of grips 26, 27, 28 and 29.

Forearm grips 27 and 29 should be sufficiently large to hold the forearm in position and provide adequate space between said grip and the punching bag to provide a comfortable fit and be capable of use by a number of different persons. Preferably, forearm grips 27 and 29 are larger than hand grips 26 and 28 as set forth hereinafter.

A preferred embodiment of the invention comprises a punching bag as described above of rectangular shape having a width of 26 inches, height of 25 inches and a depth of 10 inches. Flaps 19 and 20 will be from 4–7 inches each allowing for sufficient overlap in order that the flaps may be tied in a closed position.

Forearm grips 27 and 29 are approximately 7½ inches high by 7¾ inches wide and are placed six inches off each side wall and 2½ inches off the respective bottom or top wall.

Hand grips 26 and 28 are 8½ inches high by 2½ inches wide and are placed six inches off each side wall and 2½ inches off the respective bottom and top wall.

A preferred method of use of the invention comprises placing the punching bag 10 on the trainer or coach as shown in FIG. 1. The trainer or coach should hold the bag in a position between his waist and as high as his chin and move in and out in relation to the boxer. The boxer should punch the bag in continuous three minute intervals. In punching, the boxer's hands should go all the way back to the shoulders at shoulder level with the elbows tucked, and the boxer should keep his hands high when punching. When punching, the boxer should twist from the waist up only. The boxer's arms should be completely extended with every punch. After each punch, the hands should be brought back and kept in the up position.

It will be apparent to those skilled in the art that minor changes may be made in the construction and structure of the invention without departing from the scope of the invention.

It is claimed:

1. A portable punching bag having a rectangular shape for use in training boxers, comprising a bag formed of a durable covering material having back, front, and side walls to provide a rectangular shape; means for insertion of a filler material through one of said side walls; resilient impact absorbing filler material contained in said bag; and means for holding said punching bag connected to said punching bag, said holding means including a first set of forearm and hand grips positioned approximate the top of the rectangular punching bag for engagement of a holder's first arm and a second set of forearm and hand grips positioned approximate the bottom of the rectangular punching bag for engagement of the holder's second arm wherein said forearm grips are about twice as wide as said hand grips and wherein said punching bag is constructed to be held in close relation to the user's body at approximately waist to shoulder level.

2. A portable punching bag of claim 1 where shoulder straps are attached to the punching bag to provide additional support means.

3. A portable punching bag of claim 1 where the covering material is canvas.

4. A portable punching bag of claim 2 where the filler material is a polyurethane foam.

5. A portable punching bag of claim 1 where the covering material is a synthetic polymer material.

6. A portable punching bag of claim 1 where the filler material is a polyurethane foam.

7. A portable punching bag of claim 1 where the resilient impact absorbing material is inserted through the bottom side wall of said punching bag and is held in place by first and second overlapping flaps which are secured in a closed position by a fastening means.

8. A portable punching bag of claim 6 wherein said flaps contain eyelets and said fastening means consists of a string-like material which is passed through said eyelets.

9. A portable punching bag having a rectangular shape for use in training boxers consisting essentially of a bag formed of a canvas covering having a back, front, and side walls to provide a rectangular shape, said punching bag having a width of about 26 inches, a height of about 25 inches and a depth of about 10 inches; an opening in said top wall for insertion of a filler material in said bag; a resilient impact absorbing filler material contained in said bag, and means for holding said punching bag, said holding means of consisting of a first set of forearm and hand grips for the holder's right hand and forearm and a second set of forearm and hand grips for the holder's left hand and forearm, said forearm grips being about 7¼ inches high by about 7¾ inches wide and placed about 6 inches inward from the outer edge of each of said side walls and about 2½ inches inward from the outer edge of each of said top and bottom walls, said hand grips being about 8½ inches wide and being placed about 6 inward from the outer edge of each of said side walls and about 2 inches inward from the outer edge of each of said top and bottom walls, wherein said punching bag is constructed to be held in close relation to the user's body at approximately waist to shoulder level.

* * * * *